US006329072B1

(12) United States Patent
Honma et al.

(10) Patent No.: US 6,329,072 B1
(45) Date of Patent: Dec. 11, 2001

(54) MICROPOROUS COPPER FILM AND ELECTROLESS COPPER PLATING SOLUTION FOR OBTAINING THE SAME

(75) Inventors: Hideo Honma, Yokohama; Tomoyuki Fujinami, Fujisawa; Nobuo Ebina, Tokyo, all of (JP)

(73) Assignees: Nideo Honma, Yokohama; Ebara-Udylite Co., Ltd., Tokyo, both of (JP)

( * ) Notice: Subject to any disclaimer, the term of this patent is extended or adjusted under 35 U.S.C. 154(b) by 0 days.

(21) Appl. No.: 09/355,983

(22) PCT Filed: Feb. 19, 1998

(86) PCT No.: PCT/JP98/00689

§ 371 Date: Aug. 23, 1999

§ 102(e) Date: Aug. 23, 1999

(87) PCT Pub. No.: WO98/37260

PCT Pub. Date: Aug. 27, 1998

(30) Foreign Application Priority Data

Feb. 21, 1997 (JP) ..... 9-052507

(51) Int. Cl.[7] ..... C23C 15/00; B05D 1/18

(52) U.S. Cl. ..... 428/618; 428/674; 427/98; 427/443.1; 106/1.23; 106/1.26

(58) Field of Search ..... 427/437, 98, 443.1; 106/1.26, 1.23; 428/613, 606, 936, 618, 674

(56) References Cited

U.S. PATENT DOCUMENTS

| | | | | |
|---|---|---|---|---|
| 4,563,217 | * | 1/1986 | Kikuchi et al. | 106/1.23 |
| 4,684,550 | * | 8/1987 | Milius et al. | 427/437 |

FOREIGN PATENT DOCUMENTS

| | | |
|---|---|---|
| 0 248 522 | 12/1987 | (EP) . |
| 56-81694 | 7/1981 | (JP) . |
| 1-309997 | 12/1989 | (JP) . |
| 2-118097 | 5/1990 | (JP) . |
| 1-16176 | 4/1992 | (JP) . |
| 6-306768 | 11/1994 | (JP) . |
| 8-243365 | 9/1996 | (JP) . |

* cited by examiner

*Primary Examiner*—Deborah Jones
*Assistant Examiner*—Bryant Young
(74) *Attorney, Agent, or Firm*—Oblon, Spivak, McClelland, Maier & Neustadt, P.C.

(57) ABSTRACT

A printed circuit board comprising a metal copper film having $10^5$ to $10^9$ micropores per square centimeter wherein the metal copper film is prepared by dipping a plating object into an electroless copper plating solution comprising a copper ion, a complexing agent, a hypophosphorus acid compound, a metallic catalyst for initiating the reductive reaction, and a compound containing an acetylenic bond.

4 Claims, 1 Drawing Sheet

MICROPOROUS COPPER FILM AND ELECTROLESS COPPER PLATING SOLUTION FOR OBTAINING THE SAME

This application is a 371 of PCT/JP98/00689 (Feb. 19, 1998).

TECHNICAL FIELD

The present invention relates to a microporous metal copper film, and more particularly, to a metal copper film having a vast number of micropores of a micron unit and to an electroless copper plating solution capable of obtaining this copper film. The present invention also relates to a plating product provided with this metal copper film.

BACKGROUND ART

A multi-layer printed circuit board is conventionally manufactured by first preparing a copper clad laminate for the inner layer by processing a copper foil on the copper clad laminate to form a printed circuit; then subjecting the above copper foil to a surface roughening treatment (generally comprising degreasing, followed by a soft etching process as exemplified by treatment with ammonium persulfate, sodium persulfate, cupric chloride, sulfuric acid-hydrogen peroxide system and the like, as well as an activating treatment); subsequently building an acicular film of copper oxide or cuprous oxide on top of the foil by a process such as blackening or browning; and bonding a copper clad laminate for the outer layer or copper foils in multiple layers with a material impregnated with a thermosetting resin (i.e. a "prepreg") to fabricate a multi-layer laminated board having a high adhesion strength.

Since electric continuity has to be established to each layer of the multi-layer laminated board manufactured in the above process, a through-hole plating on holes drilled through the board is required. However, the conventional method has had a drawback whereby penetration of the acid solution used in the catalyst treatment process for plating through-holes or penetration of the plating solution in the electroless copper plating process tends to dissolve the film made from copper oxide or cuprous oxide, thereby causing a phenomenon called "pink ring"(i.e. "haloing").

On the other hand, there is an alternative method in which a printed circuit is formed on a copper clad laminate using a copper foil that is pre-processed by surface roughening to eliminate the need for surface roughening as well as the oxide film forming processes required in the method described above, thereby providing a multi-layer printed circuit board. This method, however, has shortcomings such as inferior pattern resolution for the printed etching resist or the etching resist for ultra-violet exposure, which are associated with the surface roughness of the copper foil.

In order to correct the above shortcomings, the present inventors have recently developed a method for forming a uniform and acicular copper film with excellent adhesion strength using electroless copper plating (Japanese Patent Application Laid-Open No. 116176/1992 and International Patent Application No. PCT/JP96/03829). This technology enabled manufacturing of a copper clad laminate having a copper film with a high adhesion strength, without the aforementioned shortcomings.

DISCLOSURE OF THE INVENTION

While earnestly making research efforts to improve on the technology described above, the present inventors have discovered the fact that, rather than a uniform and acicular copper film, a microporous copper film can be produced depending on the surfactant used, thereby providing a copper clad laminate having a copper film with high adhesion strength.

Such a microporous copper film is not yet known at present. The present inventors have further found that not only this microporous copper film can be utilized for the copper clad laminate but also this film itself can be used as a metal filter or a catalyst or its carrier. These findings have led to the completion of the present invention.

Accordingly, it is an object of the present invention to provide a metal copper film having one hundred thousand to one billion micropores per one square centimeter.

Another object of the present invention is to provide an electroless copper plating solution comprising a copper ion, a complexing agent, a hypophosphorous acid compound as a reducing agent, and a metallic catalyst for initiating the reductive reaction, characterized by further comprising a compound containing an acetylenic bond.

Yet another object of the present invention is to provide a plating product having a microporous copper film produced by dipping a plating object into the above electroless copper plating solution.

BEST MODE FOR CARRYING OUT THE INVENTION

Figure 1:
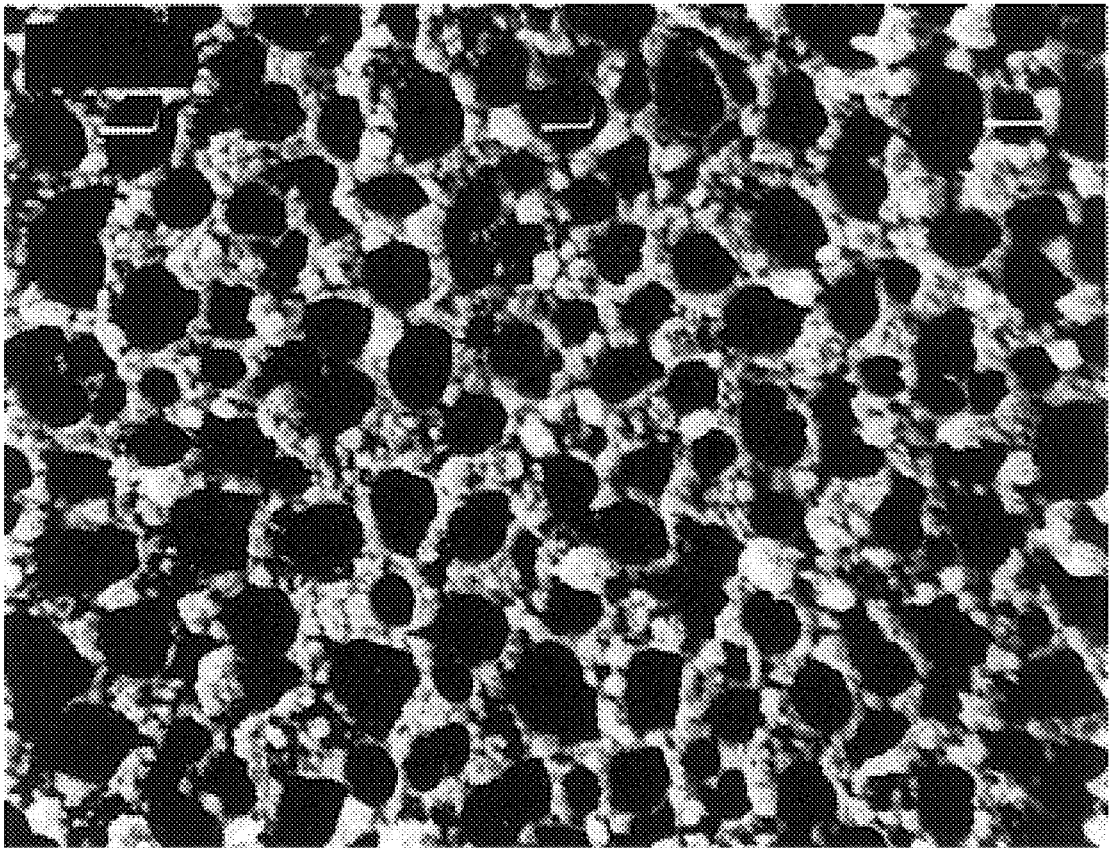
FIG. 1 is a photograph (magnification of 5,000) of a crystal structure showing the outward appearance of the electroless copper film of the present invention.

As examples of the compound containing an acetylenic bond which is formulated in the electroless copper plating solution of the present invention, compounds represented by the following formula (I) are given:

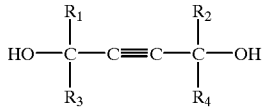

(I)

wherein $R_1$ and $R_2$ respectively represent an alkyl group and $R_3$ and $R_4$ respectively represent a hydrogen atom or a lower alkyl group.

Specific examples of the compound containing an acetylenic bond include alkyne diols such as 2,4,7,9-tetramethyl-5-decyne-4,7-diol, 3,6-dimethyl-4-octyne-3,6-diol, and the like. The compounds containing an acetylenic bond are commercially available under the trademark Surfinol 104 (manufactured by Nisshin Chemical Industries Co., Ltd.).

Except for the compound containing an acetylenic bond as described above, the electroless copper plating solution in the present invention can be prepared from known materials for an electroless copper plating solution that uses a hypophosphorous acid compound as a reducing agent. For example, a copper ion for electroless copper plating can be obtained from ordinary copper salts such as copper sulfate, cupric chloride, or copper nitrate; and for the complexing agent, any compound that can complex the above copper ions, such as citric acid, tartaric acid, malic acid, EDTA, Quadrol, or glycine, can be used.

For the hypophosphorous acid compound as a reducing agent, compounds such as hypophosphorous acid or sodium hypophosphite can be mentioned. As the metallic catalyst for initiating the reductive reaction, metals such as nickel, cobalt, or palladium can be used in the form of inorganic salts.

Referring to each ingredient of the electroless copper plating solution in the present invention, if nickel is used as the metallic catalyst for initiating the reductive reaction, it is preferable to have a copper ion concentration of 0.007 to 0.160 mol/l and a nickel ion concentration of 0.001 to 0.023mol/l, where the desirable mol ratio between copper and nickel ions is approximately at 13:1.

It is preferable to use a complexing agent in an amount of 1 to 10 times the amount of copper ions by mol ratio. Also, it is preferable to formulate 0.1 to 1.0 mol/l of a hypophosphorous acid compound as a reducing agent.

In the event that a metal other than nickel is used as the metallic catalyst for initiating the reductive reaction, the quantity and ratio given above may be applied while the most suitable quantities can be determined separately by experiments.

The electroless copper plating solution in the present invention, in addition to ingredients as described above, may be formulated with various other ingredients as appropriate. One such other ingredient is a buffer agent for conditioning the solution pH.

It is noted here that an embodiment may be possible where the electroless copper plating solution in the present invention is prepared as a concentrated composition for dilution to several times or more by a diluent such as water at the time of application.

The electroless copper plating in the present invention can be performed using the electroless copper plating solution of the present invention prepared as described above, and in accordance with conventional plating procedures. In performing these procedures, it is preferable to remove dissolved oxygen beforehand from the electroless copper plating solution, and to this end, blowing an inert gas such as nitrogen or argon through the solution prior to commencing the plating process is preferred.

Also, it is preferable that the temperature of the electroless copper plating solution for electroless copper plating in the present invention be 40 to 100° C., and that the plating time be 5 minutes or longer. Further, for the electroless copper plating in the present invention, although it is preferable to use vibrational stirring to prevent unnecessary oxidation of the solution, an inert gas may also be used to simultaneously perform stirring and deoxidizing. Furthermore, it is preferable to control the pH within the range of 8 to 10 in the electroless copper plating in the present invention.

The electroless copper film deposited from the above electroless copper plating solution has an outward appearance shown in FIG. 1. The number of pores ranges from $10^5$ to $10^9$ per square centimeter and generally from $3\times10^6$ to $3\times10^8$ per square centimeter. Also, the diameter of micropores ranges from 0.01 to 100 $\mu$m and generally from 0.1 to 10 $\mu$m.

Such a copper film having a vast number of micropores has great significance in that this is a novel material which has not been conventionally known and that the film can be produced in a chemically simple method.

This copper film has excellent adhesion strength resulting from the impregnation of a vast number of micropores with a prepreg. In addition, various applications of the copper film are under consideration in view of the vast number of micropores.

For example, the copper film is allowed to deposit on a smooth glass plate or a plastic plate and then peeled off to produce a copper foil having a vast number of micropores, which can be utilized as a filter. Furthermore, a material produced by depositing an adequate metal including a precious metal such as rhodium or another metal such as nickel, on such a copper foil may be used as a catalyst.

In the electroless copper plating method of the present invention, it is possible to add an acetylenic bond-containing surfactant disclosed in Japanese Patent Application Laid-open No. 116176/1992, e.g. Surfinol 465 (manufactured by Nisshin Chemical Industries Co., Ltd.) to the electroless copper plating solution to obtain a copper film having a vast number of micropores formed by small acicular crystals grown over the entire surface.

Other features of the invention will become apparent in the course of the following description of the exemplary embodiments which are given for illustration of the invention and are not intended to be limiting thereof.

EXAMPLE 1

Preparation of electroless copper plating solution (1):

An electroless copper plating solution was prepared based on the composition given below, according to the conventional method:

| (Composition) | |
|---|---|
| Copper sulfate | 0.032 mol/l |
| Sodium citrate | 0.052 mol/1 |
| Sodium hypophosphite | 0.270 mol/l |
| Boric acid | 0.500 mol/l |
| Nickel sulfate | 0.0024 mol/l |
| Surfinol 104 | 1.0 g/l |
| pH | 9.0 |

*Manufactured by Nisshin Chemical Industries Co., Ltd.

Using the above electroless copper plating solution, electroless copper plating was performed on a copper clad laminate for the inner layer (FR-4; epoxy resin) at 60° C. for 30 minutes. The resulting copper film was examined with a scanning electron microscope to confirm the formation of micropores as shown in FIG. 1.

EXAMPLE 2

Strength of adhesion to a resin substrate:

The strength of adhesion of the microporous copper film of the present invention to various resin substrates was evaluated in terms of the peel strength of a multi-layer board which was prepared by adhering the copper film to the resin substrates through a prepreg after electroless copper plating using the composition of Example 1.

As a result, the adhesion strength in case of FR-4 was 1.2 kgf/cm, and the adhesion strength in case of a BT-800 resin (bismaleimide triazine) was 0.7 kgf/cm. These results were higher than in case of a blackening treatment. In case of a PPE-S resin (polyphenylene ether), the adhesion strength was 0.2 kgf/cm when the microporous copper film of the present invention was provided, whereas little adhesion strength can be obtained when a blackening treatment was carried out.

As is clear from the above results, the microporous copper film of the present invention is effective for inner layer copper foil treatment especially for recent resin substrates having high heat resistance, electric reliability, chemical resistance, and the like.

EXAMPLE 3

Preparation of electroless copper plating solution (2):

An electroless copper plating solution was prepared based on the composition given below, according to the conventional method:

| (Composition) | |
|---|---|
| Copper sulfate | 0.032 mol/l |
| Sodium citrate | 0.052 mol/l |
| Sodium hypophosphite | 0.270 mol/l |
| Boric acid | 0.500 mol/l |
| Nickel sulfate | 0.0024 mol/l |
| Surfinol 104* | 1.0 g/l |
| Surfinol 465* | 0.1 g/l |
| pH | 9.0 |

*Manufactured by Nisshin Chemical Industries Co., Ltd.

Electroless copper plating was performed on a copper clad laminate for the inner layer (FR-4) in the same manner as in Example 1. The adhesion strength evaluated was 1.3 kgf/cm. The resulting copper film was examined with a scanning electron microscope to confirm the formation of small acicular crystals grown over the entire surface including the inner surface of the micropores.

Industrial Applicability

The microporous copper film of the present invention is deposited between a base copper foil and each of various resin substrates whereby a high adhesion strength can be obtained. Various applications are anticipated thanks to the microporous characteristics.

The microporous copper film of the present invention may be utilized, for example, as a metal microfilter or a catalyst or its carrier.

What is claimed is:

1. A printed circuit board comprising a metal copper film having $10^5$ to $10^9$ micropores per square centimeter wherein the metal copper film is prepared by dipping a plating object into an electroless copper plating solution comprising a copper ion, a complexing agent, a hypophosphorous acid compound, a metallic catalyst for initiating the reductive reaction, and a compound containing an acetylenic bond, wherein the compound containing an acetylenic bond is represented by the formula (I):

(I)

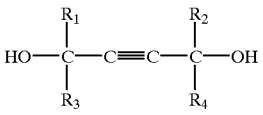

wherein $R_1$ and $R_2$ respectively represent an alkyl group and $R_3$ and $R_4$ respectively represent a hydrogen atom or a lower alkyl group.

2. An electroless copper plating solution comprising a copper ion, a complexing agent, a hypophosphorous acid compound as a reducing agent, and a metallic catalyst for initiating the reductive reaction, further comprising a compound containing an acetylenic bond, wherein the compound containing an acetylenic bond is represented by the formula (I):

(I)

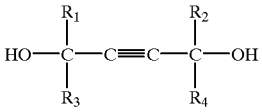

wherein $R_1$ and $R_2$ respectively represent an alkyl group, and $R_3$ and $R_4$ respectively represent a hydrogen atom or a lower alkyl group.

3. An electroless plating method comprising:

dipping a plating object into an electroless copper plating solution comprising a copper ion, a complexing agent, a hypophosphorous acid compound, a metallic catalyst for initiating the reductive reaction, and a compound containing an acetylenic bond to deposit a microporous copper film, wherein the compound containing an acetylenic bond is represented by the formula (I):

(I)

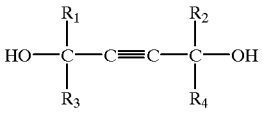

wherein $R_1$ and $R_2$ respectively represent an alkyl group and $R_3$ and $R_4$ respectively represent a hydrogen atom or a lower alkyl group.

4. A printed circuit board comprising a plating product having a microporous copper film which is prepared by dipping a plating object into an electroless copper plating solution comprising a copper ion, a complexing agent, a hypophosphorous acid compound, a metallic catalyst for initiating the reductive reaction, and a compound containing an acetylenic bond, wherein the compound containing an acetylenic bond is represented by the formula (I):

(I)

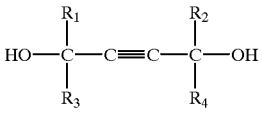

wherein $R_1$ and $R_2$ respectively represent an alkyl group and $R_3$ and $R_4$ respectively represent a hydrogen atom or a lower alkyl group.

* * * * *